United States Patent [19]

Pretty

[11] 4,210,046

[45] Jul. 1, 1980

[54] CROSS BEAM PRESS AND CONTROL

[75] Inventor: Frederick A. Pretty, Alveston, England

[73] Assignee: USM Corporation, Farmington, Conn.

[21] Appl. No.: 860,318

[22] Filed: Dec. 14, 1977

[30] Foreign Application Priority Data

Dec. 18, 1976 [GB] United Kingdom ..... 52982/76

[51] Int. Cl.[2] ..... B26D 5/12; B26D 7/26

[52] U.S. Cl. ..... 83/525; 83/530; 83/534; 83/539

[58] Field of Search ..... 83/534, 525, 530, 539, 83/527, 529

[56] References Cited

U.S. PATENT DOCUMENTS

| | | | |
|---|---|---|---|
| 1,465,339 | 8/1923 | Brennan | 83/534 |
| 1,467,297 | 9/1923 | Ballard | 83/534 |
| 3,046,874 | 7/1962 | Dehn | 83/525 X |
| 3,174,377 | 3/1965 | Lischer | 83/525 |
| 3,190,166 | 6/1965 | Haas | 83/539 X |
| 3,204,506 | 9/1965 | Reinhold | 83/534 |
| 3,389,628 | 6/1968 | Banks et al. | 83/534 X |

FOREIGN PATENT DOCUMENTS

| | | | |
|---|---|---|---|
| 1235672 | 6/1971 | United Kingdom | 83/534 |

*Primary Examiner*—Frank T. Yost

*Attorney, Agent, or Firm*—William F. White; Richard B. Megley; Vincent A. White

[57] ABSTRACT

A new and improved cross-beam press includes a carriage which is mounted for movement along a cross-beam located rearwardly of the bed of the press. A movable press head is suspended from the carriage so as to be above the bed of the press. A control system controls the movement of the press head as the same travels toward and then away from the bed of the press. The control system includes means for adjusting the ultimate approach position of the press head with respect to the bed of the press. As a further feature, the bed of the press can be positioned in two different heightwise positions relative to the movable carriage.

8 Claims, 5 Drawing Figures

60
24
14
12
23
SS1
18
20
30
28
62
10
17
16
12
10

60
16
56
56
56
58
58

CROSS BEAM PRESS AND CONTROL

FIELD OF THE INVENTION

This invention is concerned with improvements in or relating to presses.

BACKGROUND OF THE INVENTION

When a press, e.g. a cutting press, is in use, it is desirable that the operator be able to readily manipulate both the work to be operated on as well as any tools, e.g. cutting dies, and generally to have good visibility over the operating area. In a conventional press, the upper platen, being mounted above the lower platen, reduces such visibility and interferes with such manipulation, unless of course in the rest condition of the press the "daylight" gap between the platens is relatively large.

To overcome this problem, various proposals have been put into practice, e.g. presses in which the upper platen (or beam) swings into and out of opposed relationship with the lower platen about an axis perpendicular to the lower platen, or is capable of moving bodily fore-and-aft of the press into and out of such relationship; such machines are respectively referred to as "swing beam" and "receding head" presses.

Alternatively a so-called "travelling head" press is available wherein a fixed cross-beam is mounted above the lower platen, being of the same, or substantially the same, depth (i.e. dimension fore-and-aft of the press) as the lower platen. The lower platen provides a support for a carriage which is movable widthwise of the lower platen and which in turn supports a hydraulic ram carrying an upper platen. In such a machine, the carriage is supported wholly beneath the cross-beam so that the upper platen always remains in opposed relationship with the lower platen, the arrangement being such that, when pressure is applied by the hydraulic ram, in an operating stroke of the press, bearing surfaces of the carriage are thrust against co-operating surfaces on the cross-beam at both the front and rear thereof.

In general, the "daylight" gap thus provided in travelling head presses is adequate to afford sufficient visibility and allow the operator room to manipulate the work and any tools on the lower platen. It will be appreciated, however, that restrictions are nevertheless imposed by the cross-beam, as compared, for example, with a swing beam press or a receding platen press.

OBJECTS OF THE INVENTION

It is an object of this invention to provide a new and improved cross-beam press.

It is still another object of this to provide a press having an improved visibility in the gap-area between the platens.

It is still another object of this invention to provide a press wherein the gap between the platen may be controllably adjusted.

SUMMARY OF THE INVENTION

In accordance with one aspect of the present invention, therefore, there is provided a travelling head press comprising a lower platen, a generally rectangular cross-beam which extends across the width of the lower platen and is arranged rearwardly thereof, thus leaving a forward portion of the lower platen accessible to the operator and facilitating manipulation of work and tools (if any) thereon, and a carriage supporting an upper platen which has an operative surface area smaller than that of the forward portion of the lower platen and which is maintained in opposed relationship with said forward portion of the lower platen as the carriage is moved along the cross-beam, and means being provided for effecting relative movement of approach between the upper and lower platens, thus to effect an operating stroke of the press, wherein the carriage is supported on two rail portions arranged at the front of the cross-beam, an upper one of said rail portions providing an upper surface, on which the carriage is supported by a roller or rollers during movement of the carriage along the cross-beam, and a lower one of said rail portions providing a lower surface, against which, in an operating stroke of the press, a bearing surface on the carriage is urged, guide means also being provided for maintaining said roller(s) and said bearing surface in alignment respectively with the upper and lower surfaces provided by the rail portions.

The guide means may comprise rollers arranged to run along front and rear faces of the upper and lower rail portions. Conveniently, however, flat bearing surfaces are provided which slide along the front and rear faces of the upper and lower rail portions. Suitable lubrication means being is also provided for facilitating sliding engagement between the faces and the bearing surfaces.

Furthermore, the bearing surfaces thus provided for slidingly engaging the front and rear faces of the lower rail portion are conveniently provided by an integral block on which the bearing surface engaging the lower surface of the lower rail portion is also provided.

The rail portions may be formed integral with the cross-beam, or may be provided either by two separate strips secured, e.g. by welding, to the cross-beam so as to project above and below the cross-beam, or by a single strip secured, again e.g. by welding, to the front of the cross-beam and projecting as aforesaid.

For moving the carriage along the cross-beam, the operator may apply manual force, but preferably power means is provided, e.g. a chain connected to the carriage and driven by an electric motor.

For effecting relative movement of approach between the platens as aforesaid, the cross-beam may be moved bodily downwards or the lower platen bodily upwards, but preferably both the cross-beam and the lower platen are fixed in relation to one another and the carriage supports a hydraulic ram by which the upper platen is carried for downward movement to effect an operating stroke of the press.

For limiting such downward movement of the upper platen, the press conveniently comprises stroke control means. Such means may comprise any conventional arrangement, e.g. where the operating stroke is effected hydraulically, a low pressure system by which the upper platen is brought under pressure on to a tool, e.g. a cutting die.

Preferably, however, and in accordance with another aspect of the invention, there is provided a press having an upper platen and a lower platen, one of which is movable towards and away from the other to effect an operating stroke of the press, hydraulically operated means for effecting movement of the movable platen towards the other, and stroke control means by which the amount of movement of the movable platen towards the other can be adjustably controlled, the stroke control means comprising a limit switch and an actuator therefor, movement of the movable platen towards the other being effective to cause relative movement of approach to take place between the limit switch and actuator, and being terminated by actuation of the limit switch by the actuator, and also comprising adjusting means whereby the relative positions of the limit switch and actuator can be varied thus to vary the position at which movement of the movable platen towards the other is terminated, wherein selector means is provided for selecting a "stroke control adjustment" cycle in which the hydraulically operated means is effective to cause the movable platen to move towards the other to a limit determined by the actuation of the limit switch as aforesaid, the hydraulic pressure applied being the same as that applied in a normal operating stroke of the press, but in which cycle, upon such actuation of the limit switch, the movable platen is locked by the hydraulically operated means against returning to its initial position, thus to allow the relative positions of the limit switch and actuator to be adjusted with the movable platen in its "end of operating stroke" position.

It will be appreciated that such a stroke control adjustment arrangement is less expensive than an arrangement utilizing a low pressure system, while having advantages, because the movable platen is locked in its "end of operating stroke" position, over a straightforward trial-and-error setting operation under full hydraulic pressure, where the movable platen is not so locked, but merely effects a complete cycle including both operating and return strokes.

For locking the movable platen as aforesaid, the hydraulically operated means preferably comprises a three-position valve e.g. a solenoid valve, which, in a normal operating cycle, is switched, by actuation of the limit switch, from a first position, in which it allows admission of hydraulic fluid under pressure to a piston and cylinder arrangement of the hydraulically operated means, to a second position, in which it allows hydraulic fluid to be exhausted from said piston and cylinder arrangement. In a "stroke control adjustment" cycle, on the other hand, upon actuation of the limit switch, the valve is switched to a third position in which the hydraulic fluid is locked in the piston and cylinder arrangement.

Upon adjusting the relative position of the limit switch and actuator, where the effect of such adjustment is to move the limit switch and actuator out of operative engagement, return of the valve to its first position is effective to cause the movable platen to move further towards the other, until the limit switch is once more actuated. Thus, where it is desired to adjust the stroke of a movable platen, e.g. in a cutting press according to the depth of a cutting die to be used, it is preferable first to ensure that the gap between the platens when the movable platen is in its "end of operating stroke" position is greater than the depth of the die.

Any conventional means may be provided for adjusting the relative positions of the limit switch and actuator; e.g. the limit switch may be mounted on a lead screw.

It will be appreciated that whereas the above stroke control adjustment arrangement is described as forming part of the travelling head press referred to above, such arrangement may be provided in any type of press wherein two platens are provided, one of which is movable relative to the other to effect an operating stroke.

In using a press, e.g. a cutting press, tools of differing depths may be used; hence the need to provide a stroke control adjustment arrangement. The range of tool depths which can be accommodated is, however, limited by the maximum "daylight" gap between the platens, less the thickness of the work. In general, therefore, especially in cutting presses, presses are designed either for shallow tools or deep tools, e.g. strip cutting dies (usually in a range of ¾" to 2" (19 to 50 mms) and forged knives (which may be in the region of 4.1/16" deep). Also a large "daylight" gap may be required if deep foam material is being cut.

It has been a customary practice, to accommodate such variations, to provide a sufficiently large "daylight" gap for any application and then to provide a deep, usually wooden, block to reduce the gap where the requirement is for a shallower gap.

In accordance with a further aspect of the present invention, there is provided a press comprising a frame, an upper and a lower platen which are supported in the frame and one of which is movable relative to the other to effect an operating stroke of the press, wherein said other platen is secured to side members of the frame by bolts and is anchored thereto by brackets, which brackets are capable of being secured on the side members in either one of two positions, in a first of which said other platen is anchored in an upper position and in a second of which said other platen is anchored in a lower position.

Where said other platen is secured by the bolts to an underside of the side members, packing is conveniently provided for use when said other platen is in a position where the "daylight" gap is greater, and, further, longer bolts may be used when said other platen is in such position.

The various objects and the above and other of the aspects of the present invention will become clearer from the following detailed description, to be read with reference to the accompanying drawings, of one cutting press in accordance with the invention. It is to be understood that this cutting press (hereinafter called "the illustrative press") has been selected for description merely by way of examplification of the invention and not by way of limitation thereof.

BRIEF DESCRIPTION OF THE DRAWINGS

The above and other features of the invention will now be particularly described with reference to the accompanying drawings in which.

DESCRIPTION OF THE PREFERRED EMBODIMENT

Figure 1:
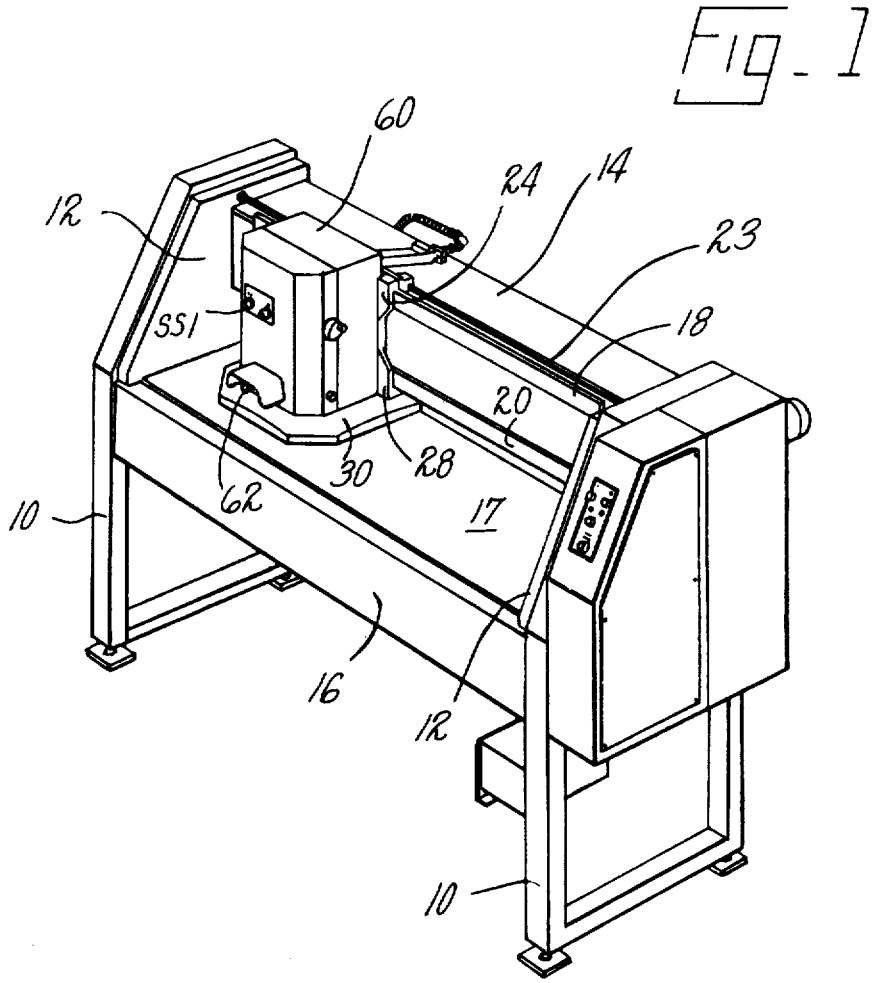
FIG. 1 is a perspective view of the illustrative press.

The illustrative press is of the type referred to as "travelling head presses" and comprises a frame comprising side supports 10 and side members 12 secured thereto, between which side portions and side members a cross-beam 14 is mounted and also a lower platen 16. The illustrative press also comprises a carriage 60 which is mounted for movement along the cross-beam 14 and which supports a hydraulic ram (not shown) by which an upper platen 30 is carried for movement towards and away from the lower platen 16. A cutting pad 17 is provided on the lower platen 16. For moving the carriage 60 along the cross-beam 14, an electric motor is provided which drives a chain connected with the carriage 60.

Figure 2:
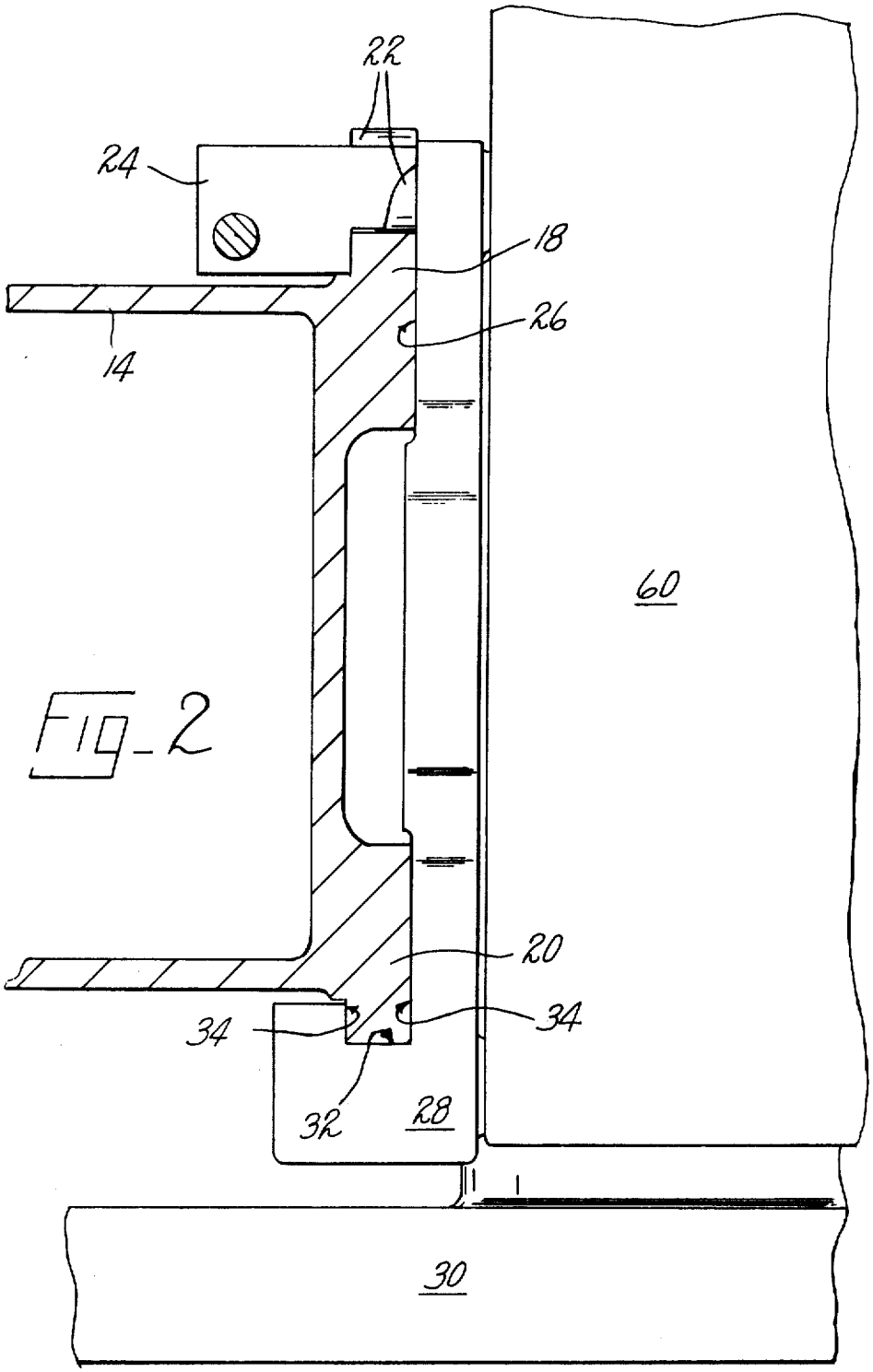
FIG. 2 is a view partly in cross-section through a cross-beam of the illustrative press, illustrating the mounting of a carriage thereon.

For supporting the carriage 60 on the cross-beam 14, the cross-beam provides an upper and a lower rail portion 18, 20 extending along a front face of the cross-beam along the width thereof. Running on an upper face of the upper rail portion 18 are two rollers 22 (one only shown in FIG. 2), the rollers 22 thus supporting the carriage as it is moved along the cross-beam. The rollers are supported in a block 24 secured to the carriage, the block also providing two guide surfaces 26 which co-operate with forward and rearward faces of the upper rail portion 18, so that the carriage is held with the rollers 22 on the upper face of the rail portion 18; furthermore, the guide surface 26 co-operating with the front face of the upper rail portion 18 is effective as a bearing surface to counter any torsional forces applied during a cutting operation due to the carriage being mounted on the front of the beam 14.

A further block 28 is carried by the carriage 60 and provides a bearing surface 32 which co-operates with a lower surface of the lower rail portion 20 during an operating stroke of the illustrative press. In addition, guide faces 34 are provided on the block 28 and co-operate with front and rear faces of the lower rail portion 20 thus to assist in maintaining the carriage in position on the rail portions 18, 20. In addition, the guide face 34 co-operating with the rear face of the lower rail portion 20 affords a bearing face during a cutting operation against any torsional forces applied because the carriage is mounted on the front of the cross-beam 14.

As is clearly seen in FIG. 1, and as will be appreciated, the cross-beam 14 is so arranged in relation to the lower platen 16 that the upper platen 30 overlies a forward, operative, portion of the lower platen and remains in such opposed relationship therewith during any movement of the carriage along the cross-beam 14.

Figure 3:
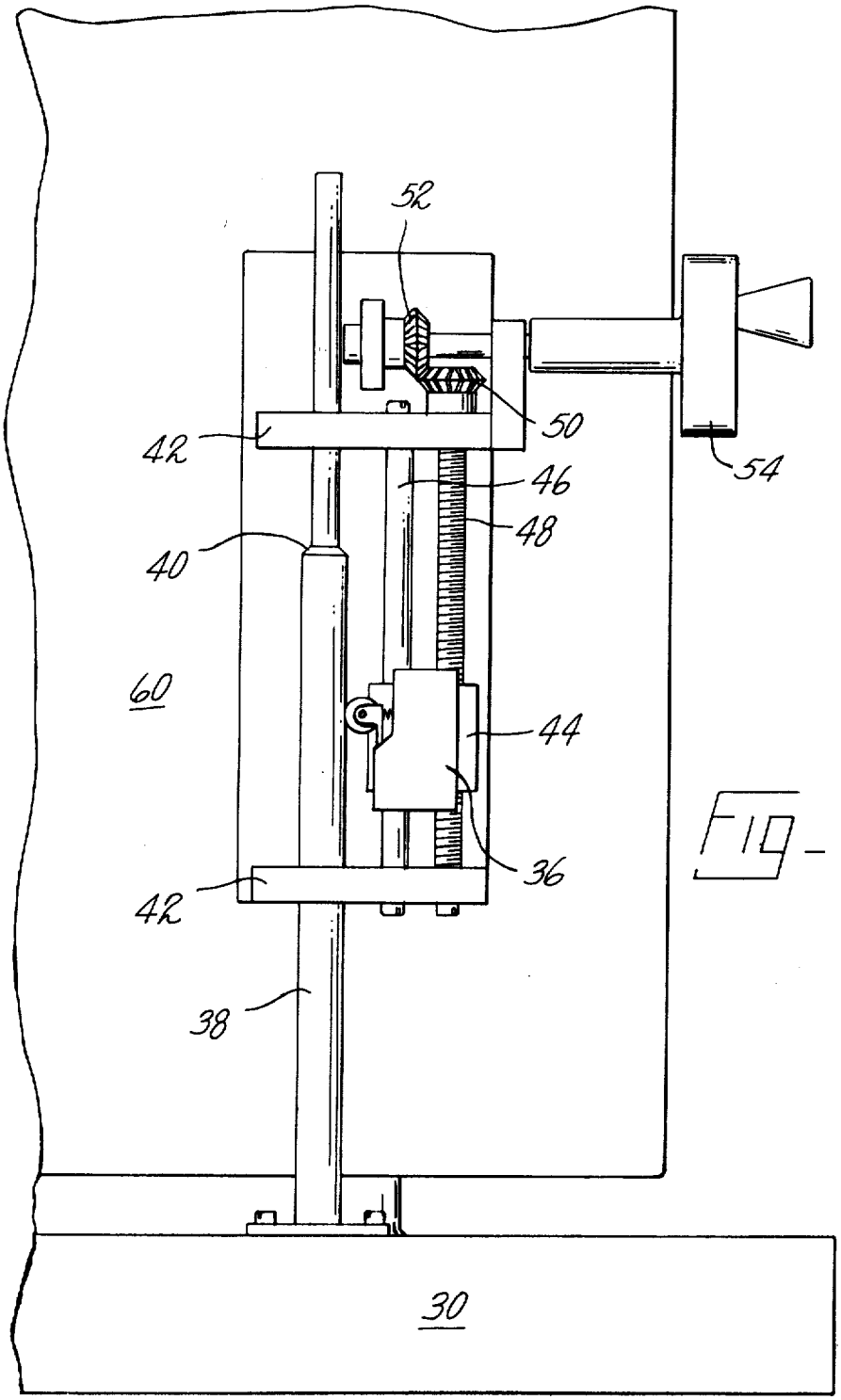
FIG. 3 is a fragmentary view of a stroke control adjustment arrangement of the illustrative press.

The illustrative press is provided with a stroke control adjustment arrangement by which the termination of an operating stroke is adjustable. This arrangement is illustrated in FIG. 3 and is seen to comprise a limit switch 36 in combination with an actuator. The actuator is in the form of a rod 38 having a cam surface 40 which acts on a plunger of the limit switch. The rod 38 is fixed to the upper platen 30, which moves towards and away from the lower platen in a cycle of operation of the illustrative press, and is carried in bearing blocks 42 fixed on the carriage 60.

For adjusting the "lower limit" position, i.e. the position in which the limit switch 36 is tripped by the face 40 on the rod, the microswitch 36 is mounted for adjustment heightwise of the rod 38, and to this end is carried by a slide block 44 which is carried on a rod 46, also supported in the bearing blocks 42. In addition, a lead screw 48 is threadedly engaged in the slide block 44 so that rotation of the lead screw is effective to cause the switch 36 to move heightwise of the rod 38. For rotating the lead screw 48, bevel gears 50, 52 are provided which are rotated by means of a hand wheel 54 mounted on the outside of the carriage 60. The manner in which the stroke control adjustment arrangement is utilized will be discussed below.

Figure 4:
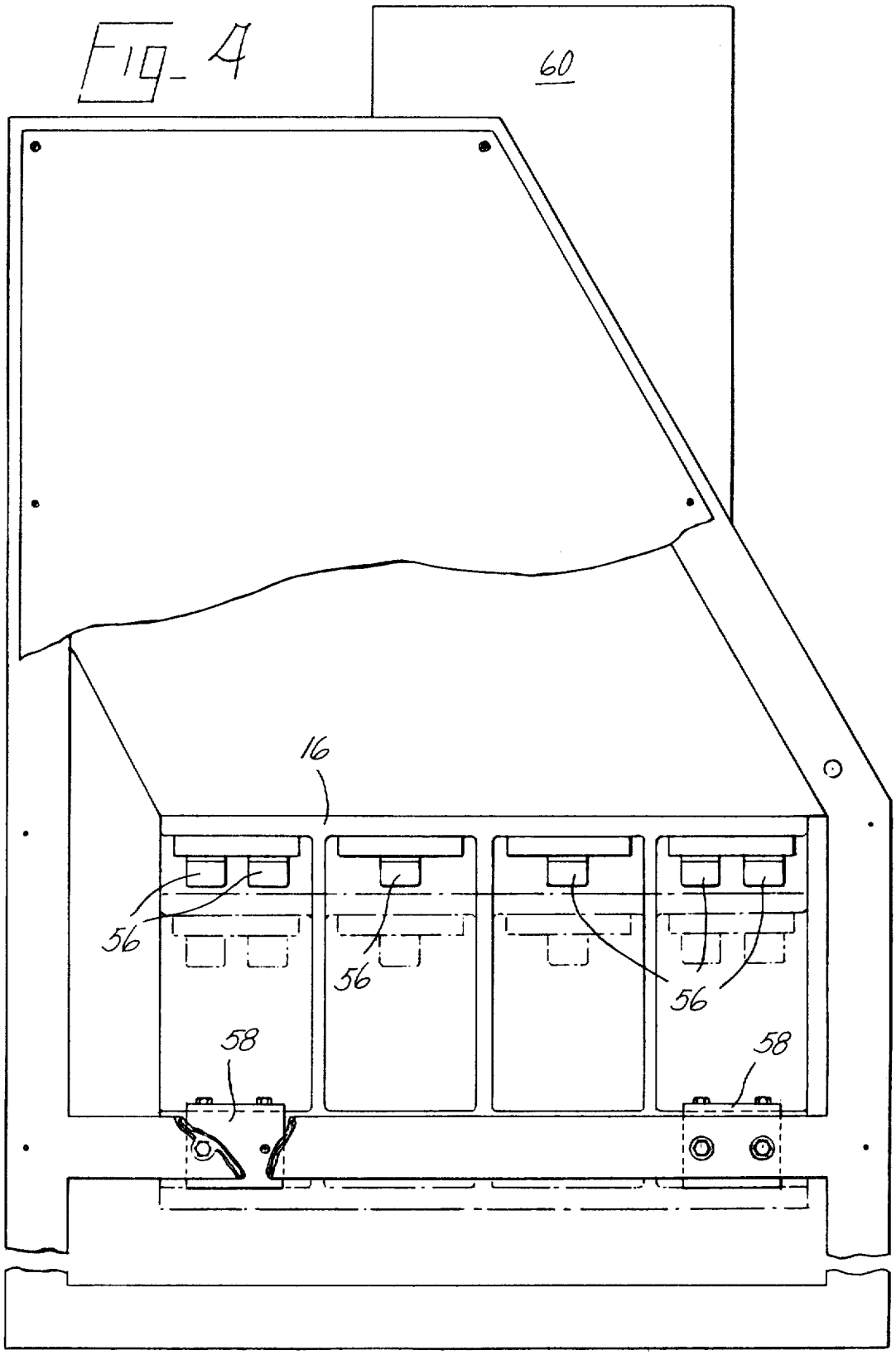
FIG. 4 is a fragmentary end view showing the mounting of a lower platen of the illustrative press in a side member of a frame thereof.

Turning now to FIG. 4, the lower platen 16 is seen to comprise four I-section girders welded together. These girders are secured to the side members 12 of the frame of the illustrative press by means of six bolts 56. This securement absorbs the cutting pressures which are applied during a cutting operation.

In addition, the lower platen 16 is anchored to the side members 10 of the frame, at each side thereof, by two brackets 58 which are secured to said side members and provide a securing surface to which the lower platen 16 is bolted. In the position shown in FIG. 4, the lower platen is mounted in the press frame for operating with relatively shallow dies; to this end, the securing faces provided by the brackets 58 extend inwardly and above the securing bolts of the brackets, i.e. are, viewed from the front of the illustrative press, in the shape of an inverted L. On the other hand, if the press is to be used for deeper dies, then the brackets can be released from the lower platen and side frames and be turned through 180°, so that the securing face thereof is positioned below the bolts securing the brackets to the side frames, i.e. are, viewed from the front of the illustrative press, in the form of an L. The lower platen may then be lowered, by releasing the bolts 56, and be secured to the under-sides of the newly positioned brackets; also packing pieces may be inserted between the lower platen 16 and the side members 12 before the bolts are once more screwed in to mount the lower platen on the side members.

For causing the upper platen 30 to move towards the lower platen 16 in carrying out an operating stroke of the illustrative press, hydraulically operated means, including the hydraulic ram referred to above carried by the carriage 60, is provided comprising a pump P driven by an electric motor M which is connected via a solenoid valve SV1 to a single-acting piston and cylinder arrangement C1 constituting the hydraulic ram. For reguating the pressure applied to the arrangement C1 a pressure relief valve PV1 is arranged in a branch line.

In a cycle of operation of the illustrative press, actuation of one of two push buttons on the press together with a joy-stick 62 (see FIG. 1) is effective, through a relay, to energize a solenoid SOL A whereupon SV1, which is a three-position valve, is moved to the right (viewing FIG. 5) to admit fluid under pressure to piston and cylinder arrangement C1. The upper platen is thereby moved downwardly, until limit switch 36 is tripped, whereupon the aforementioned relay is de-energized and a further relay becomes energized, whereupon solenoid SOL B is energized to cause solenoid valve SV1 to move to its left (viewing FIG. 5) thereby exhausting piston and cylinder arrangement C1 to tank. A spring 64 is then rendered effective to return the upper platen to its initial position. The spring, which may comprise one or more coils, is accommodated in the carriage 60.

When a stroke control adjustment cycle is required, the hydraulic circuit shown in FIG. 5 is again used and, upon tripping one of the push buttons and the joy-stick 62, the upper platen is moved downwardly under full pressure, as regulated by valve PV1, to a limit determined by limit switch 36. In this case, addition, the lower platen 16 is anchored to the side members 10 of the frame, at each side thereof, by two brackets 58 which are secured to said side members and provide a securing surface to which the lower platen 16 is bolted. In the position shown in FIG. 4, the lower platen is mounted in the press frame for operating with relatively shallow dies; to this end, the securing faces provided by the brackets 58 extend inwardly and above the securing bolts of the brackets, i.e. are, viewed from the front of the illustrative press, in the shape of an inverted L. On the other hand, if the press is to be used for deeper dies, then the brackets can be released from the lower platen and side frames and be turned through 180°, so that the securing face thereof is positioned below the bolts securing the brackets to the side frames, i.e. are, viewed from the front of the illustrative press, in the form of an L. The lower platen may then be lowered, by releasing the bolts 56, and be secured to the under-sides of the newly positioned brackets; also packing pieces may be inserted between the lower platen 16 and the side members 12 before the bolts are once more screwed in to mount the lower platen on the side members.

Figure 5:
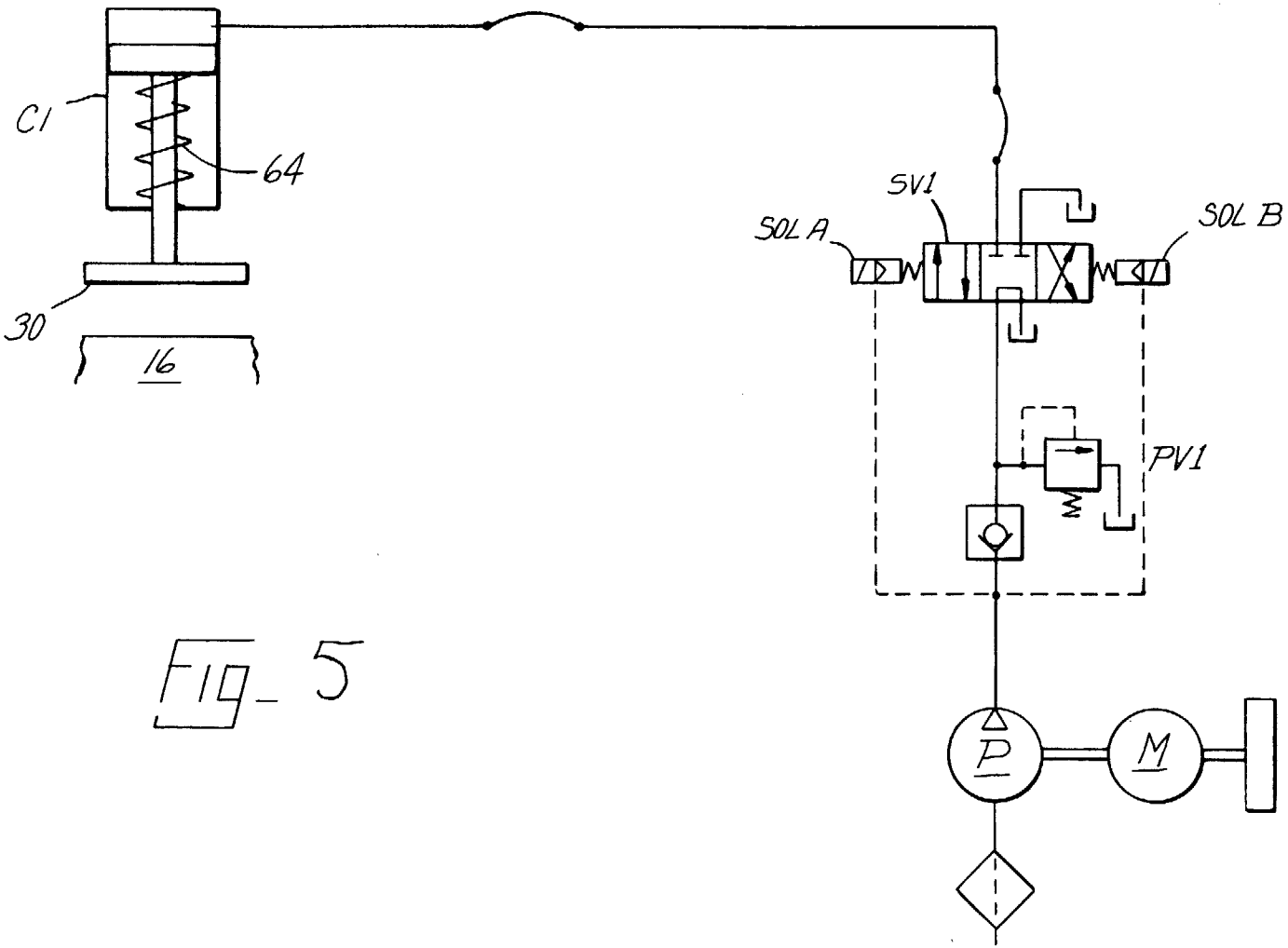
FIG. 5 is a view of a hydraulic circuit of the illustrative press.

For causing the upper platen 30 to move towards the lower platen 16 in carrying out an operating stroke of the illustrative press, hydraulically operated means, including the hydraulic ram referred to above carried by the carriage 60, is provided comprising a pump P driven, however, by the switching of a selector switch SS1 on the carriage 60 to an "adjust" position, the further relay referred to above is not energized, although the first mentioned relay is de-energized, with a result that solenoid valve SV1 moves to a neutral position (as shown in FIG. 5), wherein fluid under pressure in the line from said valve to the piston and cylinder arrangement C1 is locked, thereby locking the upper platen in its "lower limit" position. At this time, the knife (or other tool) to the depth of which the upper platen has to be set is placed on the lower platen, along side the upper platen; preferably, the operator ensures that the upper platen will not be moved downwardly in this setting operation to a point below the level of the die. Having judged the relationship between the spacing of the upper platen from the lower platen and the depth of the die, the operator then moves the limit switch 36, by operation of the handwheel 54, through what is judged to be an appropriate amount. He then once more actuates the press by means of one or more of the push buttons and the joy stick 62, whereupon solenoid valve SV1 is re-energized and fluid under pressure is admitted again to piston and cylinder arrangement C1 to move the press to its lower limit position as adjusted. This operation is repeated until the lower limit position appropriate to the cutting die is established. (It will, of course, be appreciated that, if the limit switch 36 has to be moved in an opposite direction, i.e. the lower limit is to be adjusted to a position further from the lower platen, then the re-tripping of the press will be of no effect at this stage.)

When the setting up operation is completed, selector switch SS1 is returned to a "normal" position, whereupon said further relay is energized, solenoid SOL B is also energized and the fluid in the piston and cylinder arrangement C1 is exhausted to tank, whereupon the spring 64 returns the upper platen to its initial position.

It will be appreciated that the stroke control adjustment arrangement of the illustrative press provides an inexpensive, but effective arrangement, without the need for any low pressure system being incorporated into the hydraulic circuitry, while presenting an improvement over a straightforward trial-and-error setting system utilizing "normal" operating strokes of the press.

Furthermore, by facilitating the re-positioning of the lower platen in the manner described above, the range of use of the press is enhanced.

In addition, by mounting the carriage on the front of the cross-beam, a "low profile" press is achieved, as well as providing a facility for easy manipulation of work and tools on the lower platen between operating strokes of the press.

I claim:

1. A travelling head press comprising:

a lower platen;

a cross-beam extending across the width of the lower platen and positioned rearwardly thereof, said cross-beam having a flat front face with an upper rail and a lower rail extending outwardly from the flat front face;

a carriage mounted on the upper and lower rails extending outwardly from the flat front face of the cross-beam so as to allow slidable movement therealong at a short distance from the front face;

an upper platen suspended from said carriage; and means for effecting relative movement between said upper platen and said lower platen so as to effect an operating stroke of said press.

2. The travelling head press of claim 1 wherein said carriage comprises:

at least one roller engaging an upper surface of said upper rail; and guide means for maintaining said roller and the bearing surface of said carriage in alignment with respect to said upper and lower surfaces of said upper and lower rails.

3. The travelling head press of claim 2 wherein said guide means comprises:

an integral block having guide bearing surfaces which slidably engage the front and rear faces of both said upper and lower rails, said integral block being attached to the back of the carriage housing and having a thickness which defines the spacing between the back of the carriage housing and the support rails.

4. The travelling head press of claim 1 further comprising:

means for establishing at least two different fixed positions of said lower platen with respect to said carriage.

5. The travelling head press of claim 1 wherein said lower rail includes a lower surface against which a bearing surface on said carriage is urged during an operating stroke of said press.

6. The travelling head press of claim 1 further comprising stroke control means for adjustably controlling the amount of relative movement between the upper platen and said lower platen, said stroke control means comprising:

a limit switch;

an actuator for said limit switch, said actuator being mounted for movement relative to said limit switch so as to approach the limit switch when relative movement occurs between the upper platen and the lower platen;

means for terminating the relative movement between the upper platen and the lower platen upon actuation of said limit switch by said actuator;

means for adjusting the relative positions of said limit switch and said actuator so as to thereby vary the amount of relative movement between the upper platen and the lower platen; and means for selectively locking the moveable platen at the end of its operating stroke as defined by the then existing relative position of the limit switch with respect to said actuator so as to allow for the relative positions of the limit switch and the actuator to be further adjusted with the moveable platen at its previous end of operating stroke position.

7. A press having at least two platens wherein relative movement is effected therebetween so as to effect an operating stroke of said press, a stroke control system for adjustably limiting the relative movement between said platens, said stroke control system comprising:

a limit switch;

an actuator for said limit switch, said actuator being mounted for movement relative to said limit switch so as to approach said limit switch during the operating stroke of said press;

means for terminating the relative movement between said platens upon actuation of said limit switch by said actuator;

means for adjusting the relative positions of said limit switch and said actuator so as to thereby vary the amount of relative movement between said platens; and means, responsive to the activation of said limit switch, for selectively locking the relative positions of said platens at the end of the operating stroke whereby further adjustment of the relative positions of said limit switch and said actuator may be accomplished.

8. The press of claim 7 wherein said means for effecting relative movement between said upper platen and said lower platen comprise:

a three position valve having a first position which authorizes hydraulic movement of the moveable platen towards the other platen, a second position which is switched into upon activation of said limit switch so as to cause the moveable platen to be hydraulically returned to its initial position and a third position which is switched into from the first position when the moveable platen is to be selectively locked at the end of its operating stroke as defined by the actuation of the limit switch.

* * * * *